US006779985B2

(12) United States Patent
Cho

(10) Patent No.: US 6,779,985 B2
(45) Date of Patent: Aug. 24, 2004

(54) VACUUM GENERATING DEVICE

(75) Inventor: Ho-Young Cho, Seoul (KR)

(73) Assignee: Korea Pneumatic System Co., Ltd., Seoul (KR)

( * ) Notice: Subject to any disclaimer, the term of this patent is extended or adjusted under 35 U.S.C. 154(b) by 105 days.

(21) Appl. No.: 10/271,637

(22) Filed: Oct. 15, 2002

(65) Prior Publication Data

US 2003/0072653 A1 Apr. 17, 2003

(30) Foreign Application Priority Data

Oct. 15, 2001 (KR) ..... 2001-63300

(51) Int. Cl.[7] ..... F04F 5/52
(52) U.S. Cl. ..... 417/186; 417/187
(58) Field of Search ..... 417/65, 179, 180, 417/182, 187, 186

(56) References Cited

U.S. PATENT DOCUMENTS

| | | | | |
|---|---|---|---|---|
| 4,655,692 A | | 4/1987 | Ise | 417/187 |
| 4,696,625 A | * | 9/1987 | Greenberg | 417/174 |
| 4,848,392 A | | 7/1989 | Ise et al. | 137/270 |
| 4,880,358 A | | 11/1989 | Lasto | 417/184 |
| 5,683,227 A | | 11/1997 | Nagai et al. | 417/174 |
| 6,109,885 A | | 8/2000 | Micklisch et al. | 417/297 |
| 6,155,796 A | | 12/2000 | Schmalz et al. | 417/187 |
| 6,171,068 B1 | | 1/2001 | Greenberg | 417/174 |
| 6,182,702 B1 | * | 2/2001 | Edlund et al. | 417/187 |
| 6,416,295 B1 | | 7/2002 | Nagai et al. | 417/190 |

FOREIGN PATENT DOCUMENTS

JP 11-114862 10/1997

* cited by examiner

*Primary Examiner*—Michael Koczo
(74) *Attorney, Agent, or Firm*—Lorusso Loud & Kelly LLP

(57) ABSTRACT

A vacuum generating device designed to generate negative pressure in an absorption means, such as an absorption pad, of a vacuum system, is disclosed. The vacuum generating device accomplishes the recent trend of compactness and smallness of such devices, effectively protects its ejector unit from damage, and does not have an increased production cost in comparison with conventional vacuum generating devices. The vacuum generating device includes a block body having an air inlet port, a vacuum port, and an air outlet port, an ejector unit functioning to generate negative pressure in response to an action of compressed air flowing thereto via the air inlet port, and a control valve mechanism functioning to open or close air supply paths branching from a main flow path to an air inlet chamber of the ejector unit and the vacuum port. The block body has a recess, formed by depressing a surface of the block body to a predetermined depth. The ejector unit is formed in the recess by depressing predetermined portions of the recess. A cover is set in the recess of the block body to seal the ejector unit from the outside.

7 Claims, 8 Drawing Sheets

VACUUM GENERATING DEVICE

BACKGROUND OF THE INVENTION

1. Field of the Invention

The present invention relates, in general, to vacuum generating devices and, more particularly, to a vacuum generating device designed to generate negative pressure in an absorption means, such as an absorption pad, of a vacuum system, such as a vacuum feeding system used on a production line, and release the negative pressure from the absorption means.

2. Description of the Prior Art

As well known to those skilled in the art, ejectors have been typically used for generating negative pressure in an absorption means in a vacuum system. Such an ejector may be separately installed in a vacuum system, to be used independently. Alternatively, such an ejector may be designed such that it constitutes a vacuum generating device in cooperation with some elements, such as a block body, a valve mechanism, etc., of the vacuum system.

Japanese Patent Laid-open Publication No. Heisei. 11-114862 discloses a typical example of conventional vacuum generating devices for such vacuum systems. The above conventional vacuum generating device comprises a single block body having a compressed air path, an ejector used for generating negative pressure in response to an action of the compressed air, and a control valve mechanism used for opening or closing the compressed air path of the block body. The ejector is provided at a side surface of the block body, while the control valve mechanism is provided in an upper portion of the block body. The vacuum generating device generates negative pressure in an absorption means of a vacuum system, and quickly releases negative pressure from the absorption means, as desired. Therefore, the vacuum generating device may be preferably used in a variety of vacuum systems, such as a vacuum feeding system used in an automated production line to feed workpieces to target places. However, the vacuum generating device is problematic in that the ejector is exposed outside the side surface of the block body, thus undesirably increasing the size of the device and being undesirably and easily removed from the block body by external shock.

In an effort to improve the structure and operational function of conventional vacuum generating devices, such as the above-mentioned Japanese device, U.S. Pat. No. 6,416,295 discloses another vacuum generating device, comprising a main body including four functional blocks arranged longitudinally and continuously, an ejector installed in the main body, and a control valve mechanism provided in an upper portion of the main body. The object of the above U.S. patent is to accomplish the recent trend of compactness and smallness of such vacuum generating devices by reducing the width of the device. However, the vacuum generating device disclosed in the above U.S. patent is problematic in that an undesired increase in the length of the device has resulted even though the device has a reduced width, so that compactness or smallness of the device has not been achieved. Another problem experienced in the vacuum generating device of the above U.S. patent resides in that the number of parts of the device has increased, resulting in an undesired increase in the production cost of the device.

SUMMARY OF THE INVENTION

Accordingly, the present invention has been made keeping in mind the above problems occurring in the prior art, and an object of the present invention is to provide a vacuum generating device, which accomplishes the recent trend of compactness and smallness of such devices, which effectively protects its ejector unit from damage, and does not have an increased production cost in comparison with conventional vacuum generating devices.

In order to accomplish the above objects, the present invention provides a vacuum generating device, comprising a block body having an air inlet port, a vacuum port and an air outlet port, an ejector unit functioning to generate negative pressure in response to an action of compressed air flowing into the ejector unit via the air inlet port, and a control valve mechanism functioning to open or close air supply paths branching from a main flow path to an air inlet chamber of the ejector unit and the vacuum port, the main flow path communicating with the air inlet port.

The present invention is characterized in that the block body has a recess, formed by depressing the surface of the block body to a predetermined depth, the ejector unit is formed in the recess by depressing predetermined portions of the recess, and a cover is set in the recess of the block body to seal the ejector unit from the outside. Preferably, the cover is designed such that its thickness is not greater than the depth of the recess of the block body.

In the present invention, the ejector unit is integrally formed in the block body such that the ejector unit is not exposed to the outside of the block body. Therefore, the vacuum generating device accomplishes the recent trend of compactness and smallness of such devices, and effectively protects its ejector unit from damage.

BRIEF DESCRIPTION OF THE DRAWINGS

The above and other objects, features and other advantages of the present invention will be more clearly understood from the following detailed description taken in conjunction with the accompanying drawings, in which:

FIGS. 4*a* and 4*b* are views of a cover constituting the vacuum generating device according to the preferred embodiment of the present invention, in which: FIG. 4*a* is a perspective view of the cover, and FIG. 4*b* is a sectional view of the cover;

DETAILED DESCRIPTION OF THE INVENTION

Figure 1:
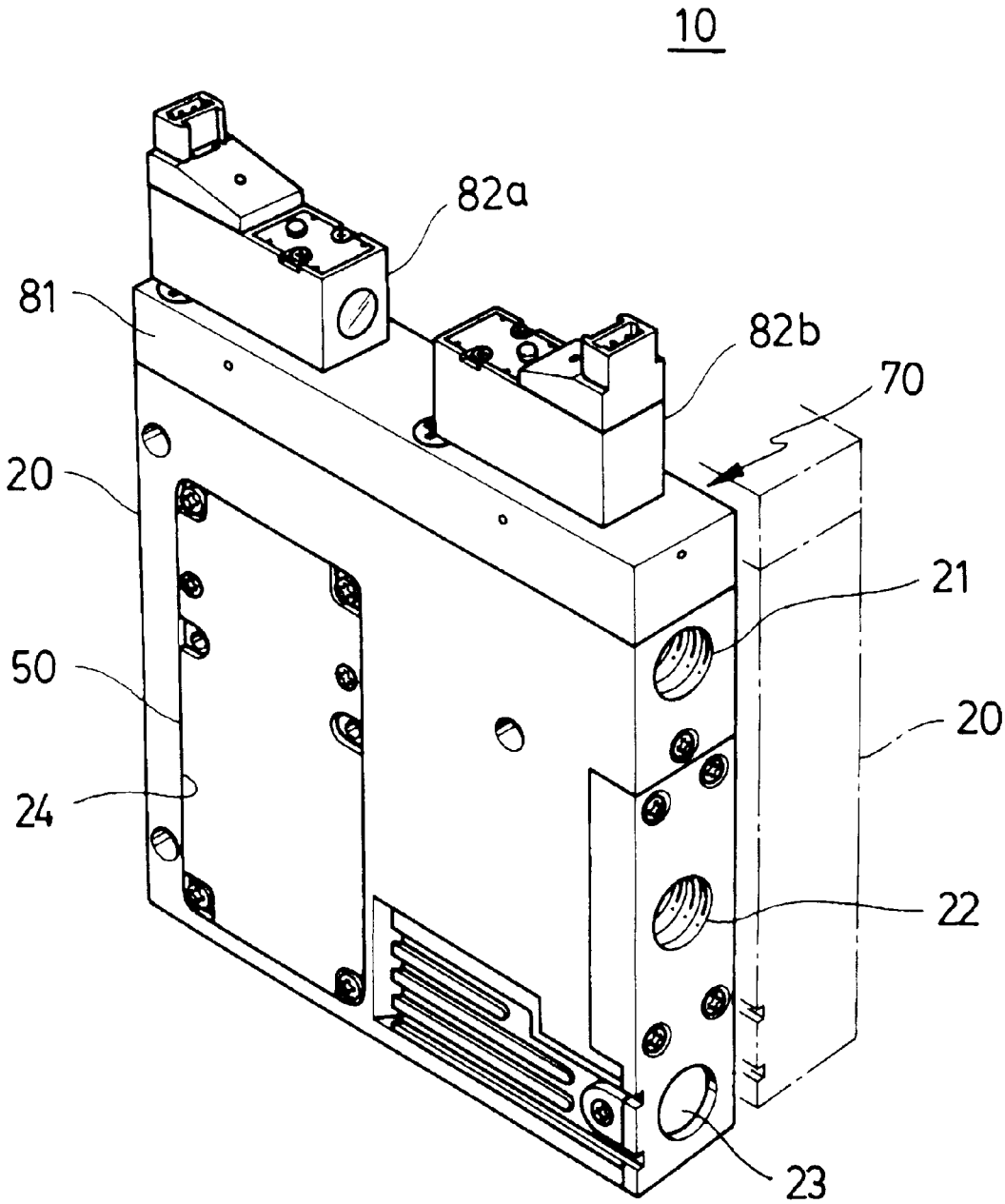
FIG. 1 is a perspective view of a vacuum generating device in accordance with a preferred embodiment of the present invention.

Reference should now be made to the drawings, in which the same reference numerals are used throughout the different drawings to designate the same or similar components.

FIG. 1 is a perspective view of a vacuum generating device in accordance with a preferred embodiment of the present invention. As shown in the drawing, the vacuum generating device 10 of the present invention is produced in the form of a module, and comprises a block body 20, with an air inlet port 21, a vacuum port 22 and an air outlet port 23 formed on a side surface of the body 20 at upper, middle and lower portions, respectively. A rectangular recess 24, having a predetermined depth, is formed on a surface of the body 20, for example the front surface. A cover 50 is set in the recess 24, and mounted to the block body 20 using setscrews. The vacuum generating device 10 also includes a control valve mechanism 70. The valve mechanism 70 is installed in the upper portion of the block body 20.

In the present invention, it is preferred to design the cover 50 such that its thickness does not exceed the depth of the recess 24. Therefore, the cover 50 completely set in the recess 24 does not project from the surface of the block body 20. Due to such a limited thickness of the cover 50, it is possible to avoid a formation of undesired gap between devices 10 when closely arranging the devices 10 into a stack.

The valve mechanism 70 includes a support plate 81 and two solenoid valves 82*a* and 82*b*. The support plate 81 is mounted on the top surface of the block body 20, while the two solenoid valves 82*a* and 82*b* are mounted on the top surface of the support plate 81.

Figure 2:
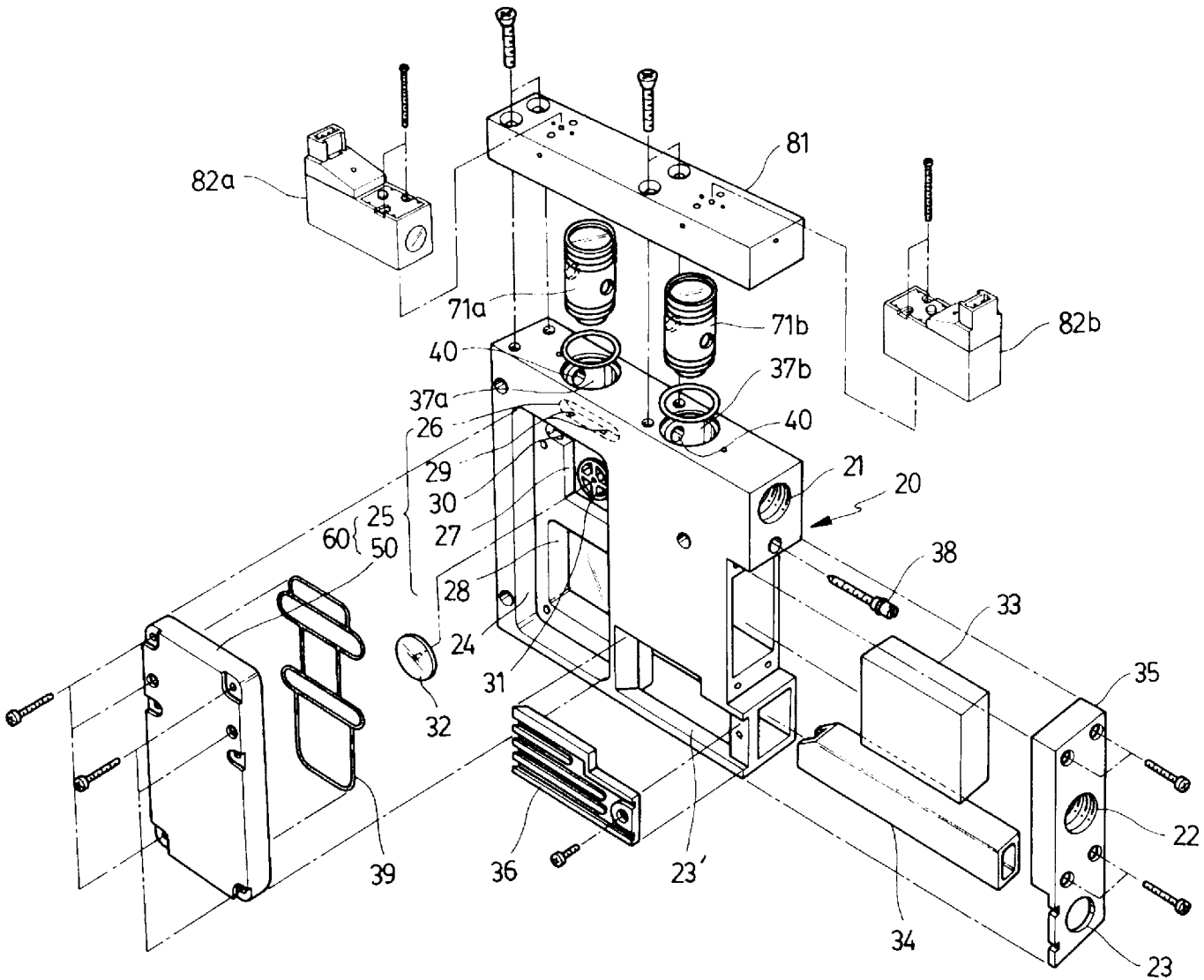
FIG. 2 is an exploded perspective view of the vacuum generating device of FIG. 1.

As shown in FIG. 2, an ejector unit 25 is provided in the recess 24. The ejector unit 25 comprises a first air inlet chamber 26, a first vacuum chamber 27 and a first air outlet chamber 28 which are formed in the recess 24 by depressing the walls of the recess 24 at predetermined portions, with a plurality of serial nozzle holes 29 and 30 formed in the ejector unit 25 to allow the chambers 26, 27 and 28 to communicate with each other. The vacuum chamber 27 of the ejector unit 25 communicates with the vacuum port 22, while the outlet chamber 28 communicates with the outlet port 23. In such a case, it is preferable to allow the vacuum chamber 27 to communicate with the vacuum port 22 through an orifice 31. A check valve 32 is installed in the orifice 31 such that the check valve 32 prevents reverse flow of air in a direction from the vacuum chamber 27 to the vacuum port 22.

The ejector unit 25 creates an ejector pump 60 in cooperation with the cover 50 set in the recess 24 of the block body 20. The cover 50 set in the recess 24 covers the three chambers 26, 27 and 28 of the ejector unit 25. When the cover 50 is set into the recess 24, a gasket 39 having a specifically designed shape is closely interposed between the cover 50 and the inside wall of the recess 24 to prevent the chambers 26, 27 and 28 from directly communicating with each other, thus preventing the direct flow of air between the chambers 26, 27 and 28.

Figure 4A:
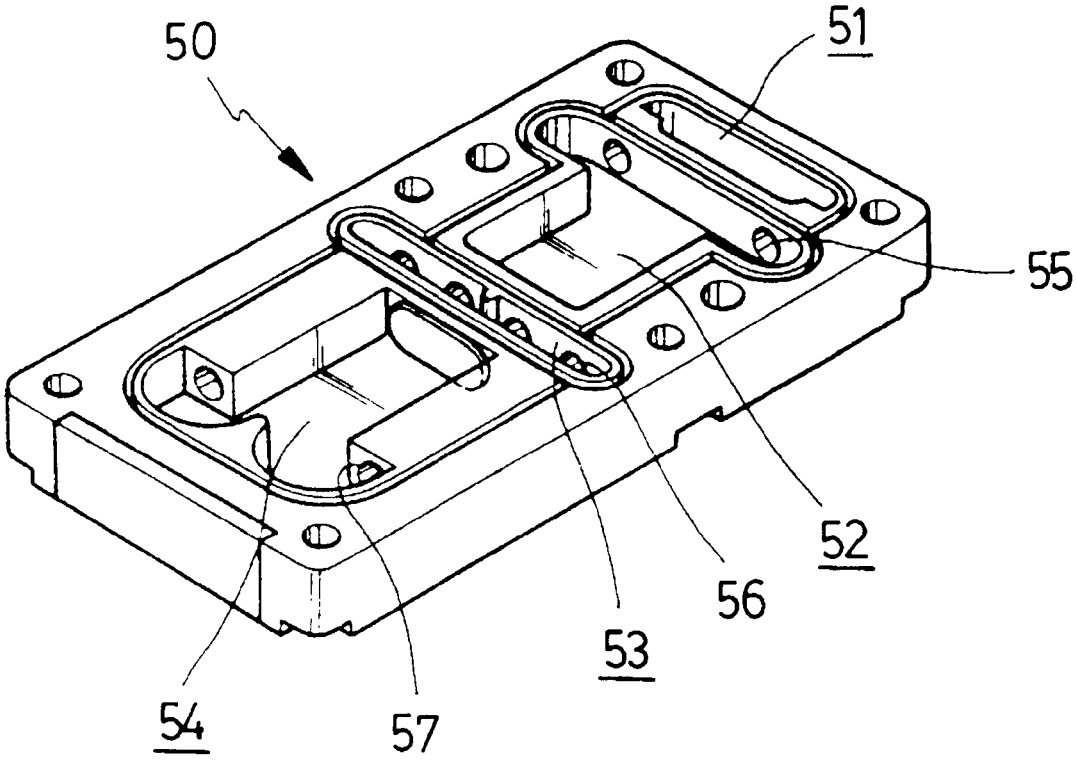
Figure 4B:
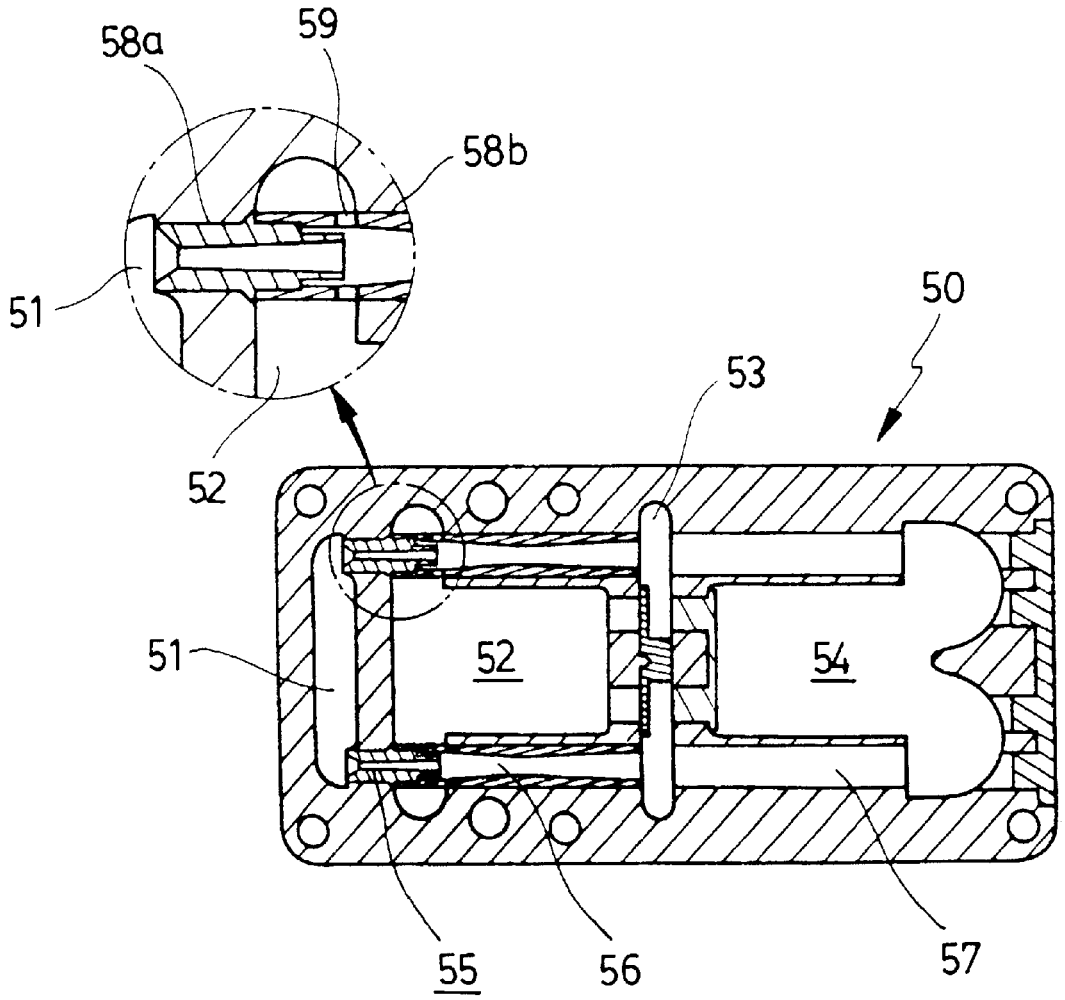

In the present invention, the cover 50 may be produced in the form of a flat panel. However, in the preferred embodiment of the present invention, the cover 50 is produced in the form of an ejector plate including a second air inlet chamber, a second vacuum chamber and a second air outlet chamber, with a plurality of serial nozzle holes allowing the chambers of the ejector plate-type cover 50 to communicate with each other. FIGS. 4*a* and 4*b* shows in detail the construction of the ejector plate-type cover 50 produced in the form of an ejector plate. In FIGS. 4*a* and 4*b*, the reference numerals 51, 52, 53 and 54 denote a second air inlet chamber, a second vacuum chamber, a sub-vacuum chamber and a second air outlet chamber formed on the cover 50, respectively. The reference numerals 55, 56 and 57 respectively denote nozzle holes, allowing the chambers 51, 52, 53 and 54 to communicate with each other. The cover 50 preferably includes first and second nozzle spouts 58*a* and 58*b* which are set in two nozzle holes 55 and 56, respectively, such that the nozzle spouts 58*a* and 58*b* are coupled to each other in the vacuum chamber 52. A plurality of radial holes 59 are formed in the sidewall of the second nozzle spout 58*b* at positions around the coupled junction of the two spouts 58*a* and 58*b*. When the cover 50 is completely set in the recess 24 of the block body 20, the inlet chamber 51, vacuum chamber 52 and outlet chamber 54 of the cover 50 coincide and communicate with the inlet chamber 26, vacuum chamber 27, and the outlet chamber 28 of the ejector unit 25, respectively.

Figure 3:
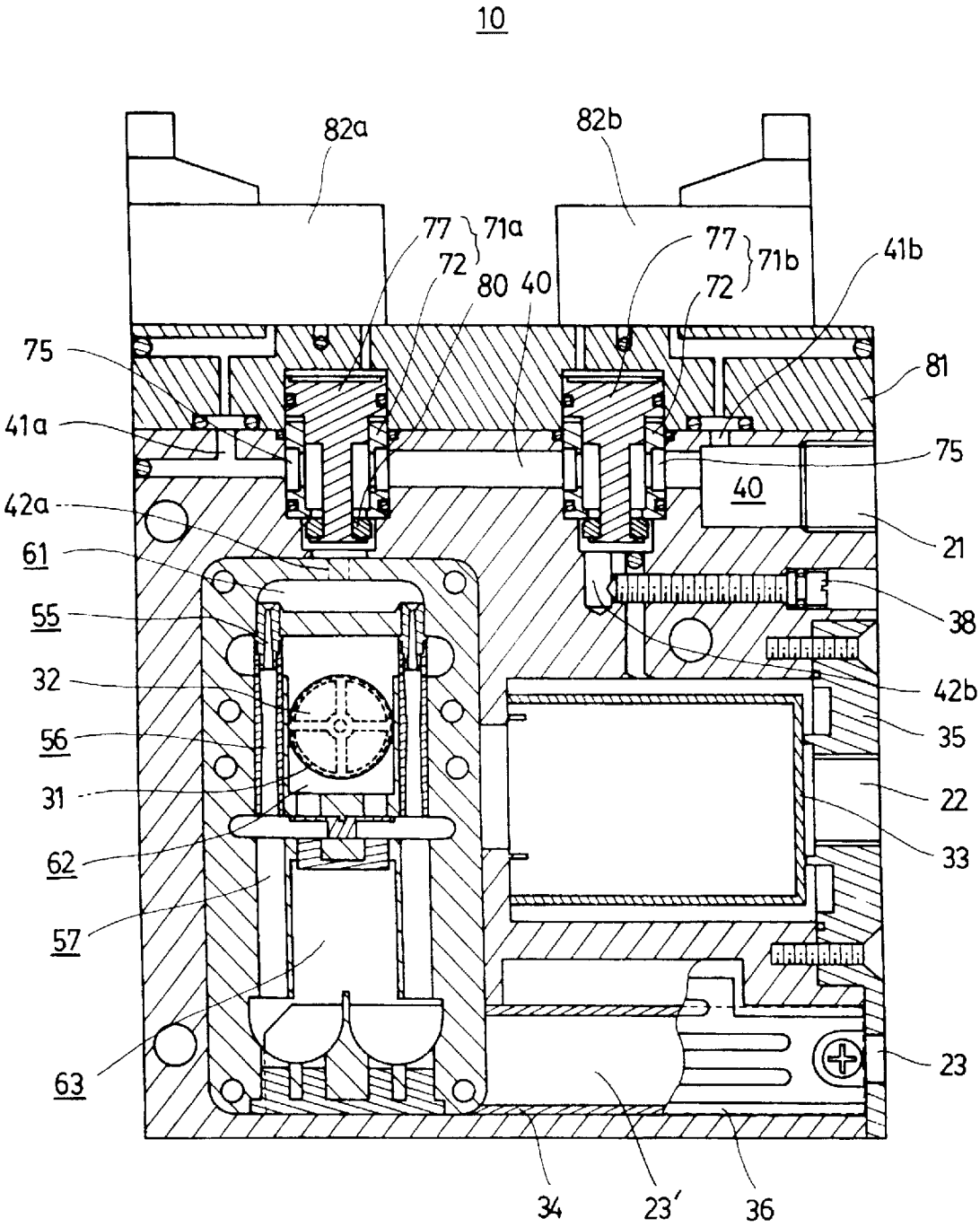
FIG. 3 is a sectional view of the vacuum generating device of FIG. 1.

Therefore, in the ejector pump 60 created by both the ejector unit 25 and the ejector plate-type cover 50 according to the preferred embodiment, several chambers 61, 62 and 63 functioning as an air inlet chamber, a vacuum chamber, and an air outlet chamber have volumes larger than those of an ejector pump having a panel-type cover, as shown in FIG. 3. Due to the enlarged volumes of the chambers 61, 62 and 63, the ejector pump 60 creates a high level of vacuum. In the ejector pump 60, the chambers 26, 27 and 28 of the ejector unit 25 communicate with each other through the nozzle holes 55, 56 and 57 of the cover 50, so that the ejector unit 25 may be not formed with the nozzle holes 29 and 30 which are separately holed in the unit 25 to allow the chambers 26, 27 and 28 to communicate with each other. The two nozzle spouts 58*a* and 58*b* also preferably allow the pump 60 to more quickly create desired vacuum.

In the drawings, the reference numeral 33 denotes a dust collecting filter that is set in the vacuum port 22, and the reference numeral 34 denotes a sound absorbing filter that is set in the outlet port 23. A filter cap 35 is preferably mounted to the side surface of the block body 20 so as to hold the two filters 33 and 34 in their positions inside the two ports 22 and 23 without allowing an undesired removal of the filters 33 and 34 from the block body 20. In such a case, the vacuum port 22 and the outlet port 22 and 23 are formed in the filter cap 35, in place of the side surface of the block body 20. The reference numeral 36 denotes a cover which covers a part of another outlet port 23'.

Two valve bores 37*a* and 37*b* are vertically formed on the upper surface of the block body 20 at two spaced positions, such that the bores 37*a* and 37*b* perpendicularly meet a main flow path 40 which is formed in the block body 20 while axially extending from the inlet port 21. The first bore 37*a*, positioned at the left side of the body 20, communicates with the inlet chamber 26 of the ejector unit 25 via a first communication hole 42*a* which extends downward from the bottom of the first bore 37*a* to the inlet chamber 26. In the same manner, the second bore 37*b*, positioned at the right side of the body 20, communicates with the vacuum port 22 of the block body 20 via a second communication hole 42*b* which extends downward from the bottom of the second bore 37*b*, as shown in FIG. 3. Therefore, compressed air introduced into the vacuum generating device 10 via the inlet port 21 may flow to the inlet chamber 26 of the ejector unit 25 and the vacuum port 22 through the first and second communication holes 42*a* and 42*b*, respectively. In the vacuum generating device 10, the two communication holes 42*a* and 42*b* thus respectively constitute compressed air supply paths for the inlet chamber 26 of the ejector unit 25 and the vacuum port 22. However, the flow of inlet compressed air inside the vacuum generating device 10 is controlled by an operation of the valve mechanism 70 such that the inlet compressed air selectively flows to only one of the inlet chamber 26 and the vacuum port 22. That is, the valve mechanism 70 controllably opens or closes the first and second communication holes 42 and 42*b* which respectively branch from the main flow path 40 to the inlet chamber 26 of the ejector unit 25 and the vacuum port 22. In the drawings, the reference numeral 38 denotes a control screw that is threaded into the block body 20 to allow a user to adjust the opening ratio of the second communication hole 42*b* to control the speed of releasing vacuum from the vacuum chamber 62, as desired.

The construction and operation of the control valve mechanism 70 will be described herein below. However, it should be understood that the construction of the valve mechanism 70 may be altered without being limited to the following construction, if the alteration does not affect the functioning of the present invention.

The control valve mechanism 70 comprises two ON/OFF control valves 71*a* and 71*b* that are set in the two valve bores 37*a* and 37*b*, respectively. The control valve mechanism 70 also includes the support plate 81 and two solenoid valves 82*a* and 82*b*. The support plate 81 is mounted to the top surface of the block body 20, such that the plate 81 receives the upper portions of the two ON/OFF control valves 71*a* and 71*b*. Of the two solenoid valves 82*a* and 82*b* mounted on the top surface of the support plate 81, the former 82*a* functions as a vacuum-on solenoid valve, while the latter 82*b* functions as a vacuum-off solenoid valve.

In the present invention, the two ON/OFF control valves 71*a* and 71*b* are pneumatic control valves that are pneumatically operated to change their state from a normal OFF-state to an ON-state. The two solenoid valves 82*a* and 82*b* are normally closed-type solenoid valves.

Figure 5:
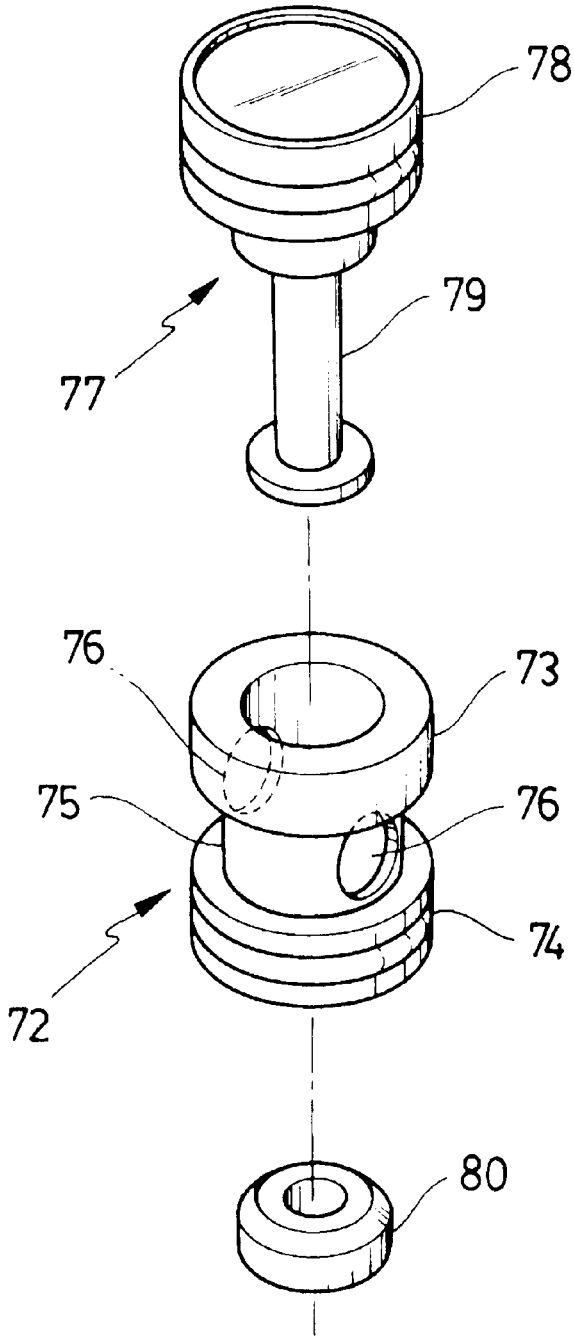
FIG. 5 is an exploded perspective view of an ON/OFF control valve constituting the vacuum generating device of FIG. 2.

As shown in FIG. 5, each of the two ON/OFF control valves 71*a* and 71*b* comprises a cylindrical retainer 72 and a valve body 77 which may be assembled with each other into a single body. The retainer 72 is an integrated cylindrical body, which is hollowed along its central axis, with upper and lower end parts 73 and 74 having the same outer diameter, and an intermediate part 75 having an outer diameter smaller than that of the two end parts 73 and 74. An opening 76 is formed at a sidewall of the intermediate part 75. The valve body 77 is an integrated member, including a valve head 78 and a valve stem 79. The diameter of the valve head 78 is determined such that the head 78 is seated on the top end of the retainer 72. The valve stem 79 integrally extends downward from the center of the valve head 78 such that the valve stem 79 movably and axially passes the central bore of the retainer 72. A rubber ring 80 is fitted over the lower end of the valve stem 79, and has a diameter capable of allowing the ring 80 to seal the lower end of the central bore of the retainer 72 in a normal state.

As shown in FIG. 3, the retainer 72 of each valve 71*a*, 71*b* is installed in an associated valve bore 37*a*, 37*b* such that the upper and lower end parts 73 and 74 are in close contact with the inner surface of the bore 37*a*, 37*b* while the valve body 77 is installed in the valve bore 37*a*, 37*b* such that it is linearly movable within a predetermined range in a vertical direction. In such a case, the intermediate part 75 of each retainer 72 is positioned at the same level as the main flow path 40 extending horizontally from the inlet port 21. Therefore, the intermediate parts 75 of the retainers 72 do not block the main flow path 40. In a normal state of the two ON/OFF control valves 71*a* and 71*b*, the lower ends of the retainers 72 are closed by the rubber rings 80 of the valve bodies 77, so that the first and second communication holes 42*a* and 42*b*, in a normal state of the valves 71*a* and 71*b*, are closed.

As described above, the two ON/OFF control valves 71*a* and 71*b* are pneumatic control valves that are pneumatically operated to change their state from a normal OFF-state to an ON-state. In order to pneumatically actuate the two ON/OFF control valves 71*a* and 71*b*, the main flow path 40 has two branch paths 41*a* and 41*b* that supply compressed air to the top surfaces of the valve heads 78 of the two ON/OFF control valves 71*a* and 71*b*, respectively. The two normally closed-type solenoid valves 82*a* and 82*b* are installed at positions where the solenoid valves 82*a* and 82*b* control the first and second branch paths 41*a* and 41*b*, respectively. In a detailed description, the first branch path 41*a* primarily extends upwardly from the main flow path 40 in a vertical direction at a left side of the block body 20, upwardly passes the support plate 81, passes the vacuum-on solenoid valve 82*a* in an ON-state, and finally passes downwardly the support plate 81 until the path 41*a* communicates with the top surface of the valve head 78 of the first ON/OFF control valve 71*a*. In the same manner, the second branch path 41*b* primarily extends upwardly from the main flow path 40 in a vertical direction at a right side of the block body 20, upwardly passes the support plate 81, passes the vacuum-off solenoid valve 82*b* in an ON-state, and finally passes downwardly the support plate 81 until the path 41*b* communicates with the top surface of the valve head 78 of the second ON/OFF control valve 71*b*. Since the two solenoid valves 82*a* and 82*b* are normally closed-type solenoid valves as described above, the two branch paths 41*a* and 41*b* are maintained at their closed states during a normal state of the two solenoid valves 82*a* and 82*b*.

Figure 6:
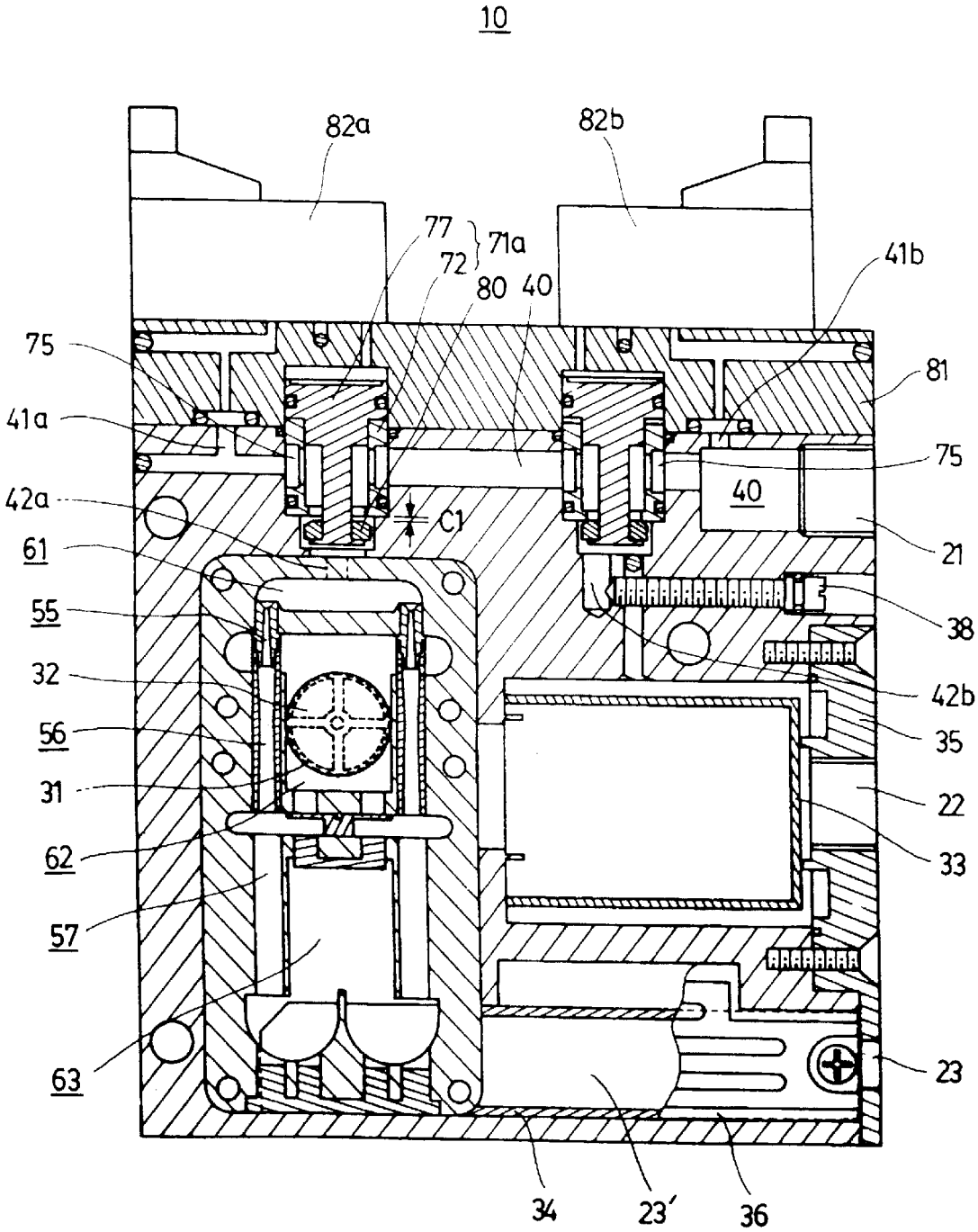
FIG. 6 is a sectional view showing the operation of the vacuum generating device of FIG. 3, when a vacuum-on solenoid valve is in an ON-state.

In order to use the vacuum generating device 10 of the present invention, an absorption means (not shown) of a vacuum system is connected to the vacuum port 22 of the device 10, while an external compressed air source (not shown) is connected to the inlet port 21 of the device 10. When the vacuum-on solenoid valve 82*a* is switched into its ON-state, compressed air is fed to the main flow path 40 through the inlet port 21, and passes through the first branch path 41*a* to impose pneumatic pressure to the top surface of the valve head 78 of the first ON/OFF control valve 71*a*. The valve body 77 of the first ON/OFF control valve 71*a* moves downward by a predetermined distance, so that a clearance C1 is created between the rubber ring 80 and the lower end of the central bore of the retainer 72 of the valve 71*a*, as shown in FIG. 6. Therefore, inlet compressed air in the main flow path 40 sequentially passes through the opening 76 formed at the sidewall of the intermediate part 75 of the retainer 72, the clearance C1, and the first communication hole 42*a*, thus being fed to the inlet chamber 61 of the ejector pump 60. The compressed air in the inlet chamber 61 sequentially flows through the nozzle holes 55, 56 and 57 to pass the vacuum chamber 62 and the outlet chamber 63, thus being discharged from the device 10 to the outside via the outlet port 23. During such an operation of the vacuum generating device 10, air in the absorption means, such as an absorption pad connected to the vacuum port 22, is sucked into the vacuum chamber 62 through the orifice 31, and is discharged from the device 10 to the outside along with the compressed air. Desired vacuum is thus created in the vacuum chamber 62, so that desired negative pressure is generated in the absorption means and allows the absorption means to take a target material, such as a workpiece.

Figure 7:
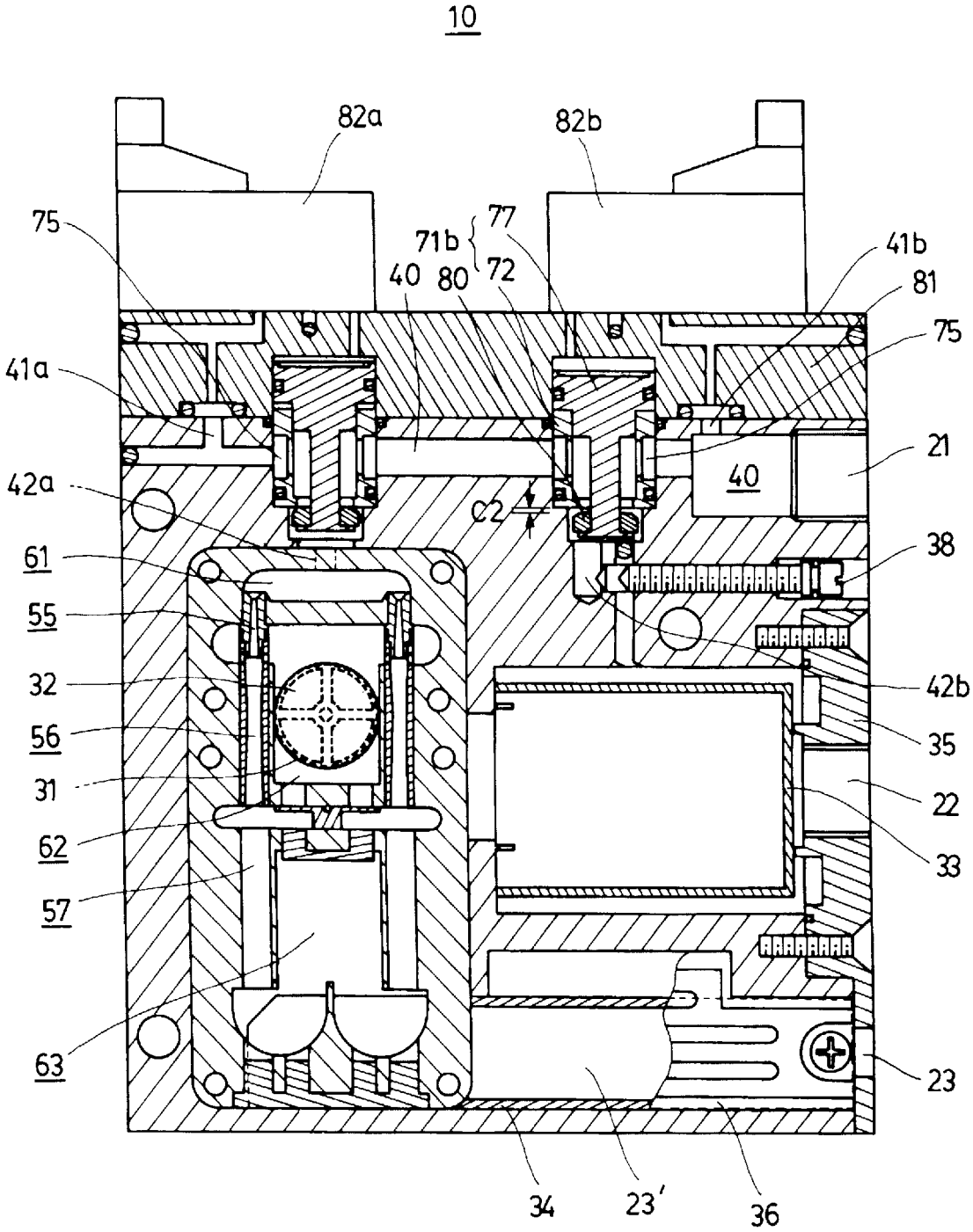
FIG. 7 is a sectional view showing the operation of the vacuum generating device of FIG. 3, when a vacuum-off solenoid valve is in an ON-state.

On the other hand, when the vacuum-off solenoid valve 82*b* is switched into its ON-state, compressed air in the main flow path 40 passes through the second branch path 41*b* to impose pneumatic pressure to the top surface of the valve head 78 of the second ON/OFF control valve 71*b*. The valve body 77 of the second ON/OFF control valve 71*b* moves downward by a predetermined distance, so that a clearance C2 is created between the rubber ring 80 and the lower end of the central bore of the retainer 72 of the valve 71*b*, as shown in FIG. 7. Therefore, inlet compressed air in the main flow path 40 sequentially passes through the opening 76 formed at the sidewall of the intermediate part 75 of the retainer 72, the clearance C2, and the second communication hole 42*b*, thus being fed to the vacuum port 22. Therefore, vacuum is quickly eliminated from the vacuum chamber 62, so that negative pressure is released from the absorption means. In the vacuum generating device 10 of the present invention, it is possible to adjust the vacuum releasing speed by appropriately tightening or loosening the control screw 38 relative to the body 20 such that the opening ratio of the second communication hole 42*b* is adjusted by the inside end of the control screw 38.

As described above, the present invention provides a vacuum generating device preferably used in a variety of vacuum systems, such as a vacuum feeding system. In the vacuum generating device of the present invention, an ejector unit is integrally formed in a block body by recessing a surface of the block body at a predetermined portion. A cover covers the ejector unit, thus preventing exposure of the ejector unit to the outside of the block body. Therefore, the vacuum generating device of this invention accomplishes the recent trend of compactness and smallness of such devices, effectively protects its ejector unit from damage, and does not increase its production cost in comparison with conventional vacuum generating devices.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A vacuum generating device, comprising a block body having an air inlet port, a vacuum port and an air outlet port; an ejector unit functioning to generate negative pressure in response to an action of compressed air flowing into the ejector unit via the air inlet port; and a control valve mechanism functioning to open or close air supply paths branching from a main flow path to an air inlet chamber of the ejector unit and the vacuum port, said main flow path communicating with the air inlet port, wherein said block body has a recess, said recess being formed by depressing a surface of the block body to a predetermined depth;

said ejector unit comprises a first air inlet chamber, a first vacuum chamber and a first air outlet chamber which are formed in said recess by depressing predetermined portions of the recess and respectively communicate with the air inlet port, the vacuum port and the air outlet port of said block body, with communicating means for allowing the first air inlet chamber, first vacuum chamber, and the first air outlet chamber to communicate with each other; and a cover is set in said recess of the block body to seal the first air inlet chamber, first vacuum chamber, and the first air outlet chamber of the ejector unit from the outside.

2. The vacuum generating device according to claim 1, wherein said communicating means comprises a plurality of serial nozzle holes formed in the ejector unit such that the nozzle holes allow the first air inlet chamber, first vacuum chamber, and the first air outlet chamber to communicate with each other.

3. The vacuum generating device according to claim 1, wherein said cover comprises an ejector plate-type cover, with a second air inlet chamber, a second vacuum chamber and a second air outlet chamber formed on the cover so as to correspond to and coincide with the first air inlet chamber, the first vacuum chamber, and the first air outlet chamber of the ejector unit, respectively, said cover also having a plurality of serial nozzle holes allowing the second air inlet chamber, second vacuum chamber, and the second air outlet chamber to communicate with each other.

4. The vacuum generating device according to claim 1, wherein said cover has a thickness not greater than the depth of said recess of the block body.

5. The vacuum generating device according to claim 3, wherein said cover is provided with two nozzle spouts, said nozzle spouts being set in the nozzle holes of the cover, respectively, such that the nozzle spouts are coupled to each other in the second vacuum chamber of the cover, with a hole formed in a sidewall of the nozzle spouts at a position around a coupled junction of said two nozzle spouts.

6. The vacuum generating device according to claim 2, wherein said cover has a thickness not greater than the depth of said recess of the block body.

7. The vacuum generating device according to claim 3, wherein said cover has a thickness not greater than the depth of said recess of the block body.

* * * * *